US006557855B2

(12) United States Patent
Wu

(10) Patent No.: US 6,557,855 B2
(45) Date of Patent: May 6, 2003

(54) SHOOTING TARGET

(76) Inventor: Wen-Long Wu, No. 5, Alley 26, Lane 62, Tung-Hsing Rd., Ta-Li City, Taichung Hsien (TW)

( * ) Notice: Subject to any disclaimer, the term of this patent is extended or adjusted under 35 U.S.C. 154(b) by 20 days.

(21) Appl. No.: 09/842,716

(22) Filed: Apr. 27, 2001

(65) Prior Publication Data

US 2002/0158412 A1 Oct. 31, 2002

(51) Int. Cl.[7] ..... F41J 9/00; F41J 5/00

(52) U.S. Cl. ..... 273/369; 273/359; 273/383; 273/387

(58) Field of Search ..... 273/359, 369, 273/370, 374, 375, 378, 406

(56) References Cited

U.S. PATENT DOCUMENTS 2,029,059 A * 1/1936 Cookson ..... 273/369
2,130,558 A * 9/1938 Murray ..... 273/369
3,064,976 A * 11/1962 Kuhn ..... 273/369
3,082,002 A * 3/1963 Goldfarb ..... 273/368
3,419,272 A * 12/1968 Miller et al. ..... 273/369
3,502,334 A * 3/1970 Tippit ..... 273/366
4,266,780 A * 5/1981 McQuary ..... 235/121
4,426,085 A * 1/1984 Dixon ..... 273/375
4,739,996 A * 4/1988 Vedder ..... 273/392
4,804,192 A * 2/1989 Matsumoto et al. ..... 273/336
5,403,017 A * 4/1995 Doss et al. ..... 273/372
5,533,732 A * 7/1996 Leinen et al. ..... 273/375
5,934,678 A * 8/1999 Theissen et al. ..... 273/386
6,168,160 B1 * 1/2001 DeOreo et al. ..... 273/336

* cited by examiner

*Primary Examiner*—Mark S. Graham
(74) *Attorney, Agent, or Firm*—Bacon & Thomas

(57) ABSTRACT

A shooting target. The shooting target includes a base with a battery chamber, a speaker and casing mounted thereon. The casing houses a gear box therein. Above the casing, there are a counter, a moving target and a lighting section. The gear box has a gear set and a driving motor. At the front and rear outer side of the gear box, there are respectively first and second cam devices pivotally disposed thereon. The counter is located above the gear box for automatically counting the toppling number of the moving target. when the moving target is hit and toppled, an audio and visual effect will be generated.

7 Claims, 12 Drawing Sheets

SHOOTING TARGET

BACKGROUND OF THE INVENTION

This invention relates to a shooting toy and particularly a shooting toy that is capable of generating audio and visual effect, and producing toppling and vibration movement for increasing amusement and entertainment effect in a shooting game.

In amusement parks and galleries, shooting game is a popular playing activity. However it needs a group of people to take part in the game at the same time to fully enjoy the fun and thrill of the game. To find and gather people required at the same time is not easy. Moreover, the shooting could cause physical injury to the players. In order to remedy these disadvantages, there are other kinds of shooting games being developed which use human or animal puppets made of paper, wood, plastic or the like as moving targets. The targets will be toppled when hit. While it eliminates the risks of people injury and may be played individually, the toppled targets have to be erected again manually. There is not much change and it loses appealing easily.

To further improve the appealing of the game, some producers have included electronic and touch sensitive elements in the shooting targets. When the touch sensitive elements are being hit, the electronic elements will generate audio and visual effect and increases the amusement effect.

Nevertheless, there are still some shortcomings, notably:

1. Conventional electronic type shooting targets use electronic elements which tend to have high defective rate, and are difficult to repair and may result in waste of costs.

2. Conventional electronic type shooting targets are moisture sensitive and are prone to break down when damped.

3. Conventional electronic type shooting targets consume a lot of electric power.

SUMMARY OF THE INVENTION

It is an object of this invention to provide a shooting target that will topple immediately when hit, and will generate audio and visual effect to increase the entertainment and amusement effect.

The shooting target according to this invention constitutes mainly a base with a battery chamber, a speaker and a casing mounted thereon. In the casing, there is a gear box. Above the casing, there are a counter, a moving target and a lighting section. The gear box has a gear set and a driving motor. The front and rear side of the gear box engage respectively and pivotally with a first and second cam means. The counter is located above the gear box for counting the toppling number of the moving target automatically. When the moving target is hit, it will topple immediately, and an audio and visual effect will be generated in the mean time.

BRIEF DESCRIPTION OF THE DRAWINGS

The invention, as well as its many advantages, may be further understood by the following detailed description and drawings, in which.

DETAILED DESCRIPTION OF THE PREFERRED EMBODIMENT

Figure 1:
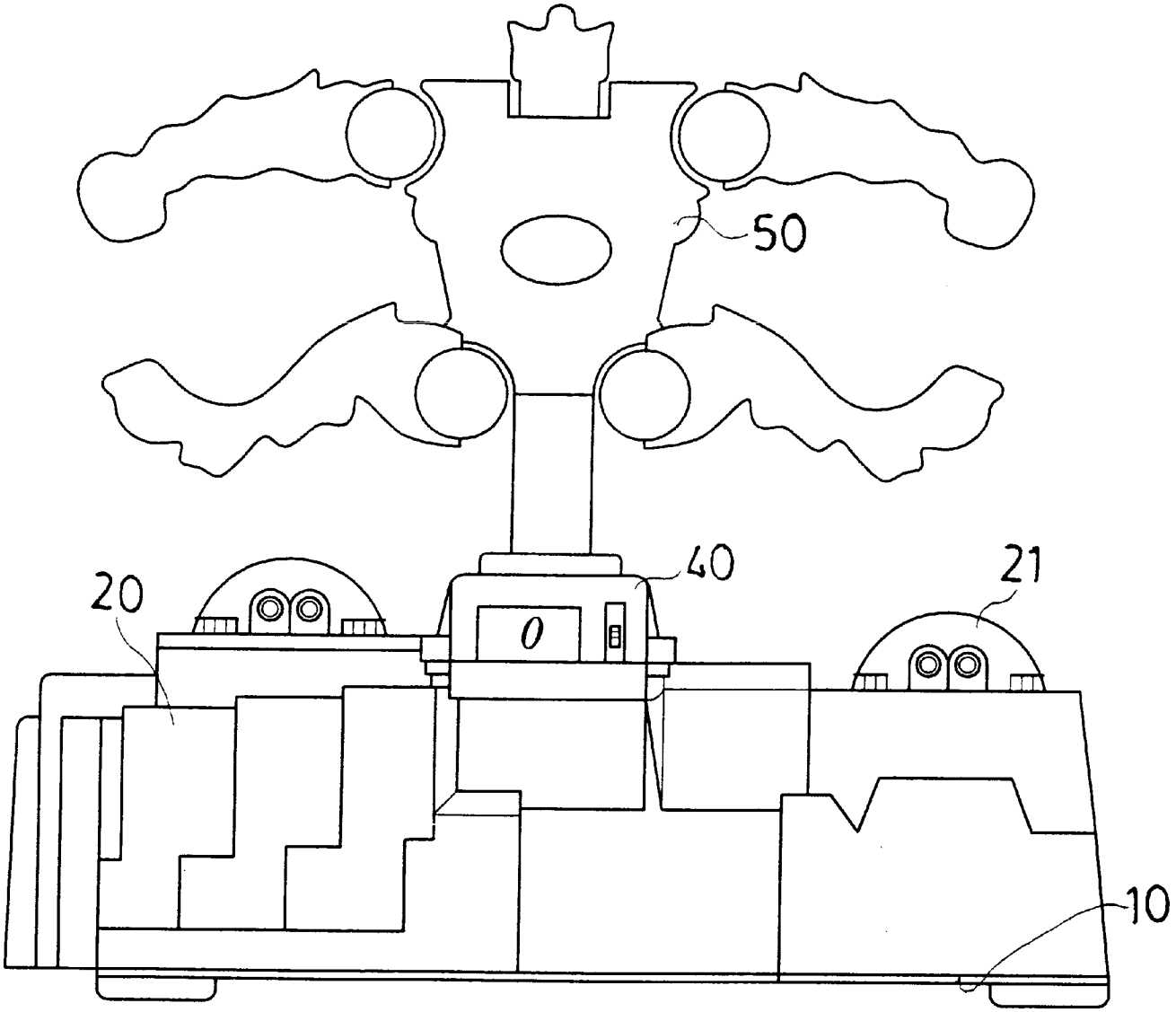
FIG. 1 is a front view of this invention.
Figure 2:
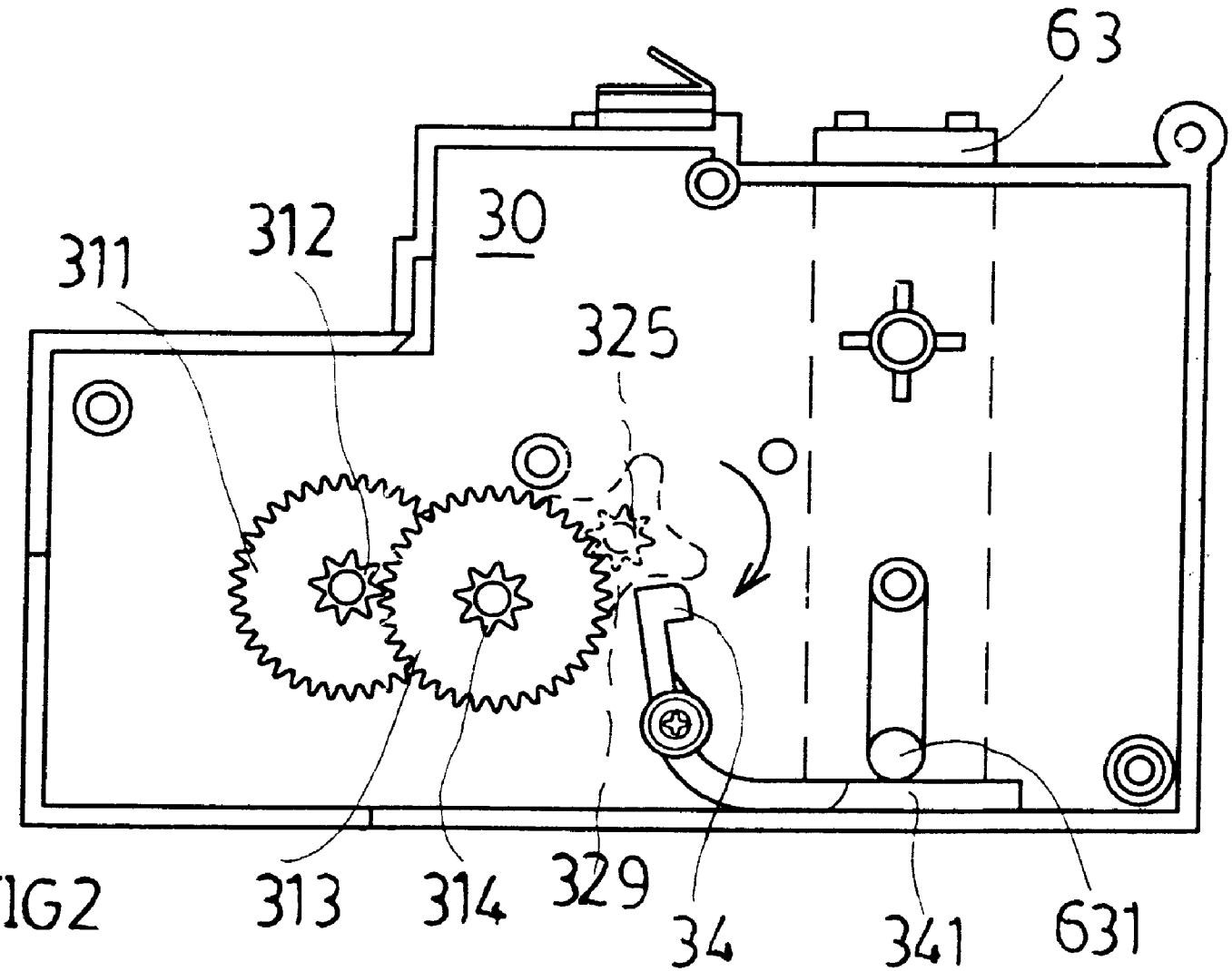
FIG. 2 is a schematic front view of a gear box structure of this invention.
Figure 3:
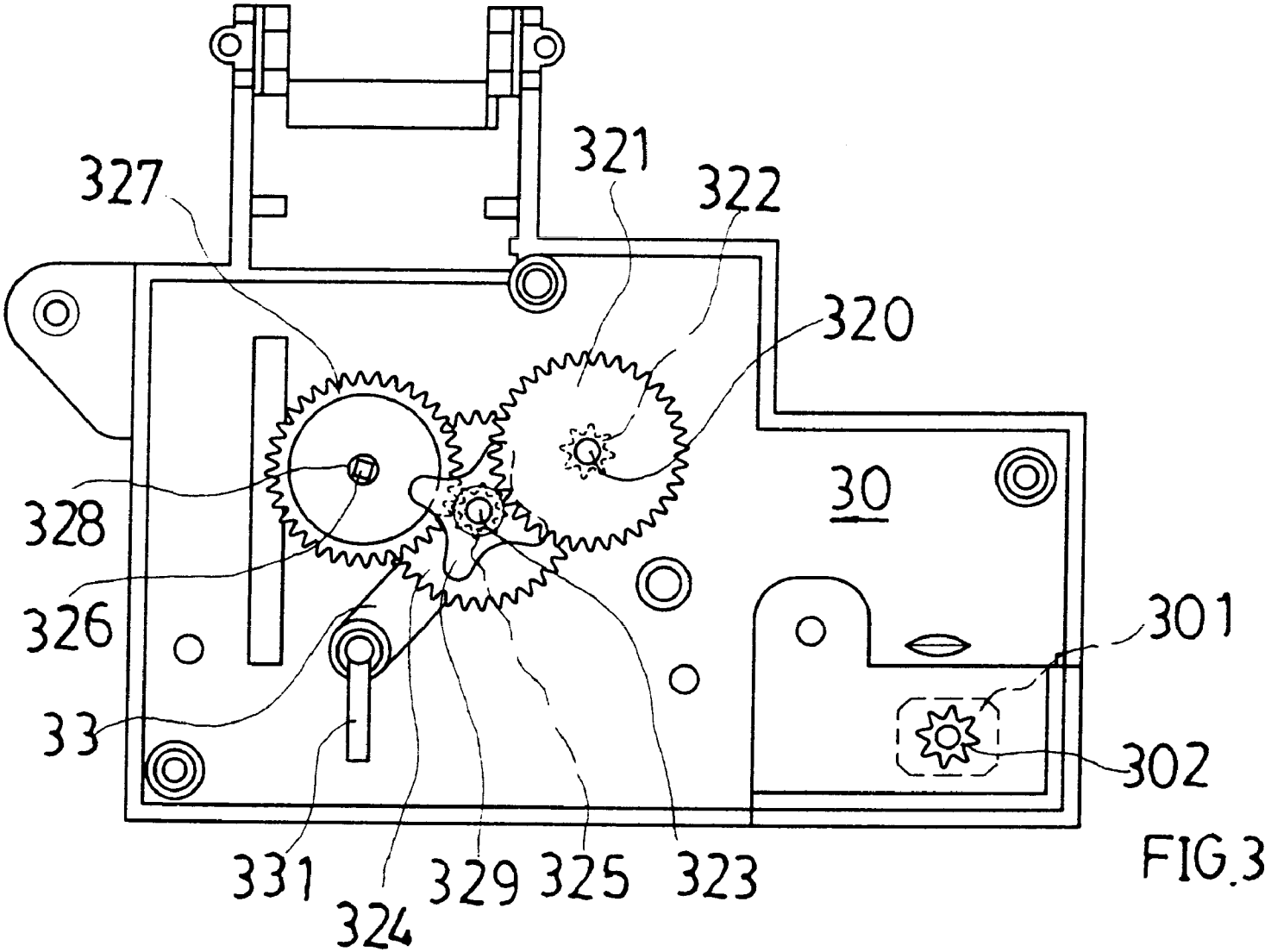
FIG. 3 is a schematic rear view of a gear box structure of this invention.
Figure 4:
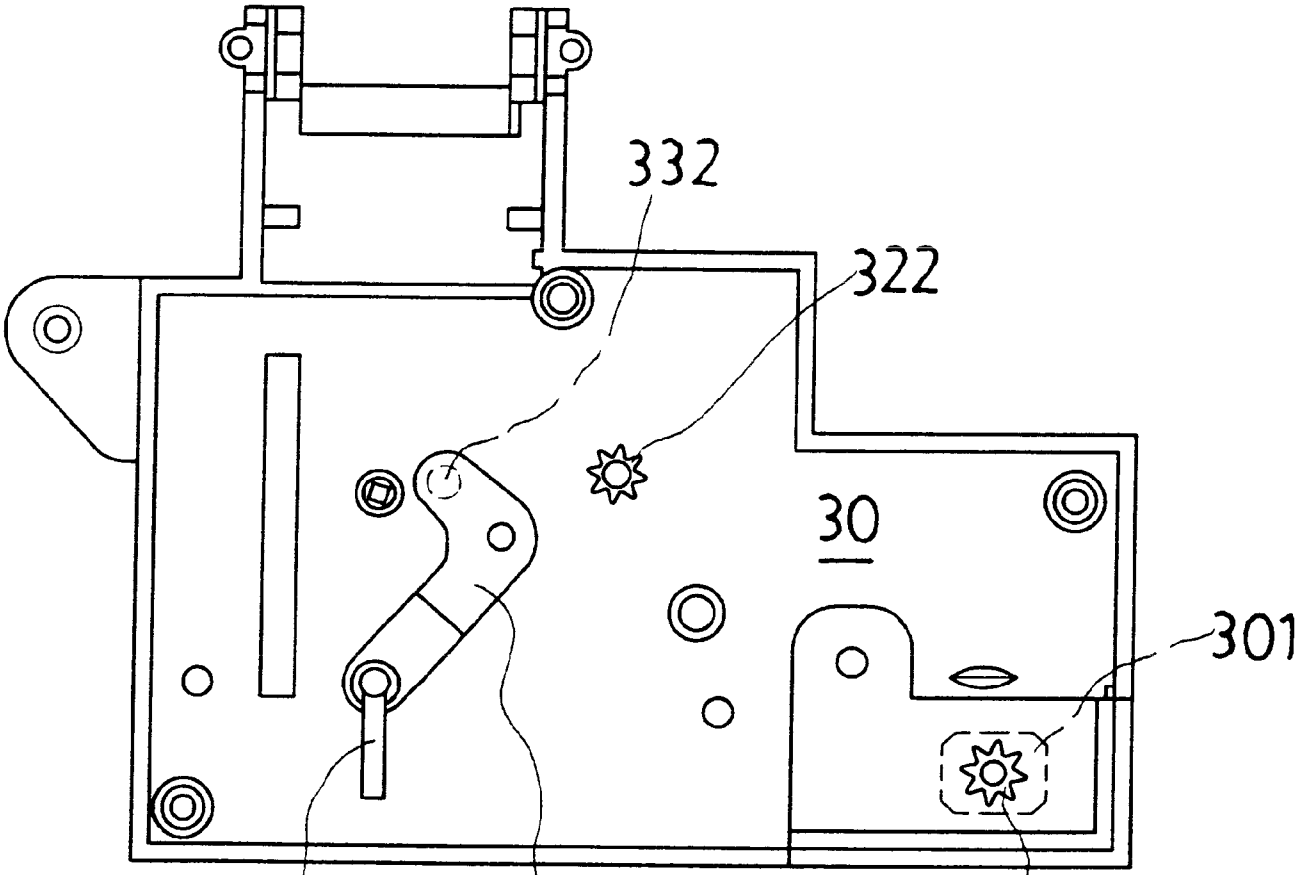
FIG. 4 is another schematic view of the gear box, showing the press rocker.

Referring to FIGS. 1, 2 and 3, this invention mainly includes a base 10 covered by a casing 20 for housing a gear box 30 therein. Above the casing 20, there are a counter 40 and a moving target 50.

The base 10 has a battery chamber 11 for housing batteries therein to provide electric power supply and a speaker 12 for generating audio sound. At one side of the base 10, there is a gear box 30.

At two sides of the top end of the casing 20, there are lighting sections 21. The counter 40 and moving target 50 are located between the lighting sections 21. The counter 40 is for counting the number of toppling of the moving target 50.

The gear box 30 includes a gear set and a driving motor 301 which engages with a motor gear 302. The motor gear 302 engages with a first gear 311 which concentrically attaches to a first pinion 312. The first pinion 312 then engages with a second gear 313 which concentrically attaches to a second pinion 314. The second pinion 314 engages with a third gear 321 mounted on a third spindle 320. The third gear 321 concentrically attaches to a third pinion 322. The third pinion 322 engages with a fourth gear 324 mounted on a fourth spindle 323. The fourth gear 324 concentrically attaches to a fourth pinion 325 which in turn attaches to a star gear 329 and engages with a fifth gear 327 mounted on a fifth spindle 326. The fifth spindle 326 has a first spring 328 mounted thereon. There is a press rocker 33 located below the fourth gear 324. The press rocker 33 has a protrusive block 331 located at a lower portion and extended outside the gear box 30, and a stub 332 located at an upper portion and extended outside the gear box 30. At one side of the second gear 313, there is a first ratchet 34 which has one end formed an extended bar 341.

Figure 5:
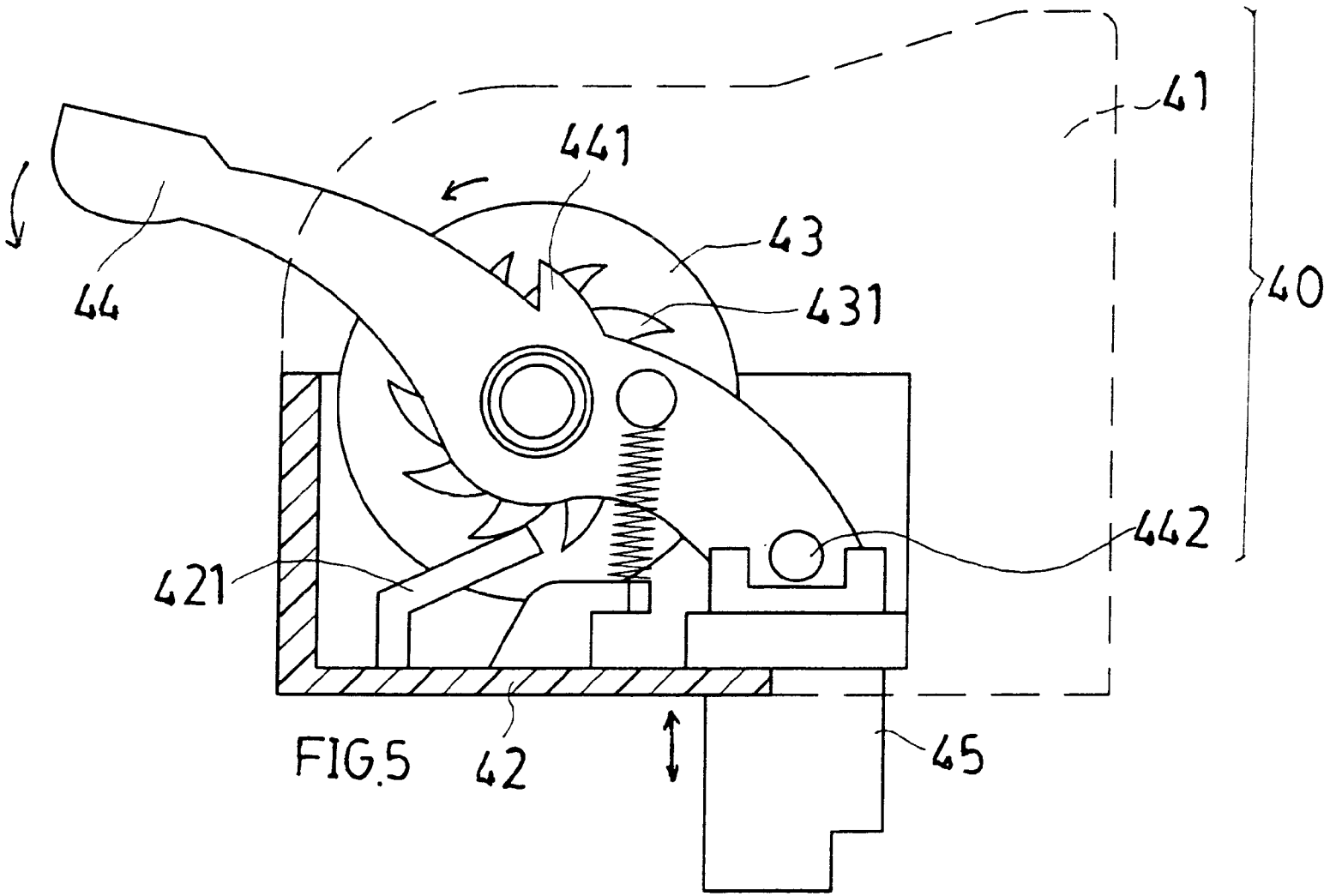
FIG. 5 is a schematic view of the counter structure of this invention.

Referring to FIGS. 1 and 5, the counter 40 is located above the gear box 30 and includes an upper cap 41 and a seat 42 with a wheel 43 pivotally located therebetween. The wheel 43 has numerals 0, 1–10 formed at the perimeter surface thereof. At one side of the wheel 43, there is a second ratchet 431 which is engageable with a pawl 441 of a rocker lever 44. Through a blocking member 421 and the second ratchet 431 and pawl 441, the wheel 43 may be turned in only one direction. The rocker lever 44 has one end extended outwards to form a cylindrical strut 442. The seat 42 has a moving block 45 located therein which has one end extended downwards outside the seat 42 and another end contact the strut 442. Thereby when the moving block 45 is being pushed once, the rocker lever 44 will move the wheel 43 one segment and be counted one time.

Figure 7:
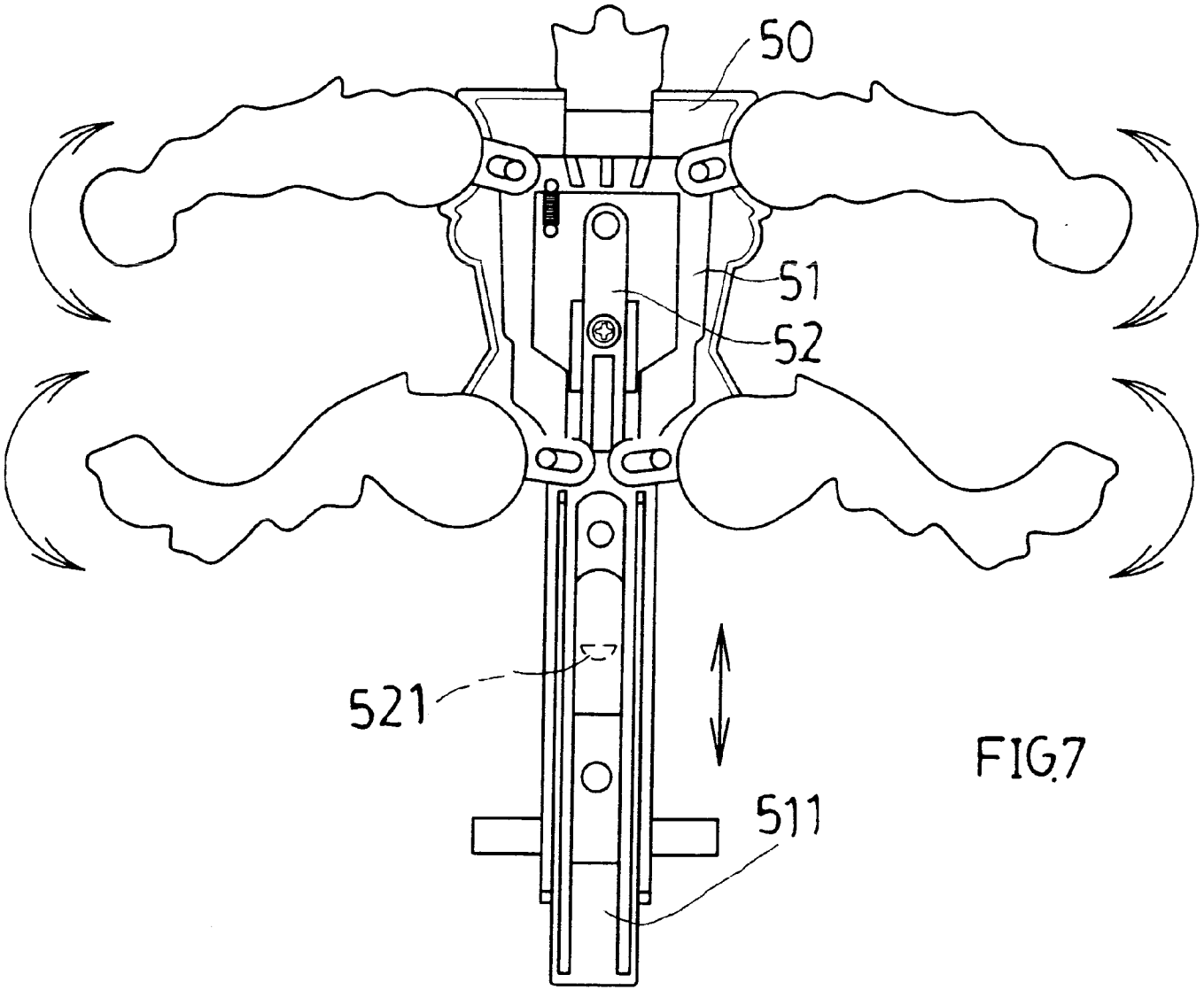
FIG. 7 is a schematic view of the moving target of this invention.
Figure 8A:
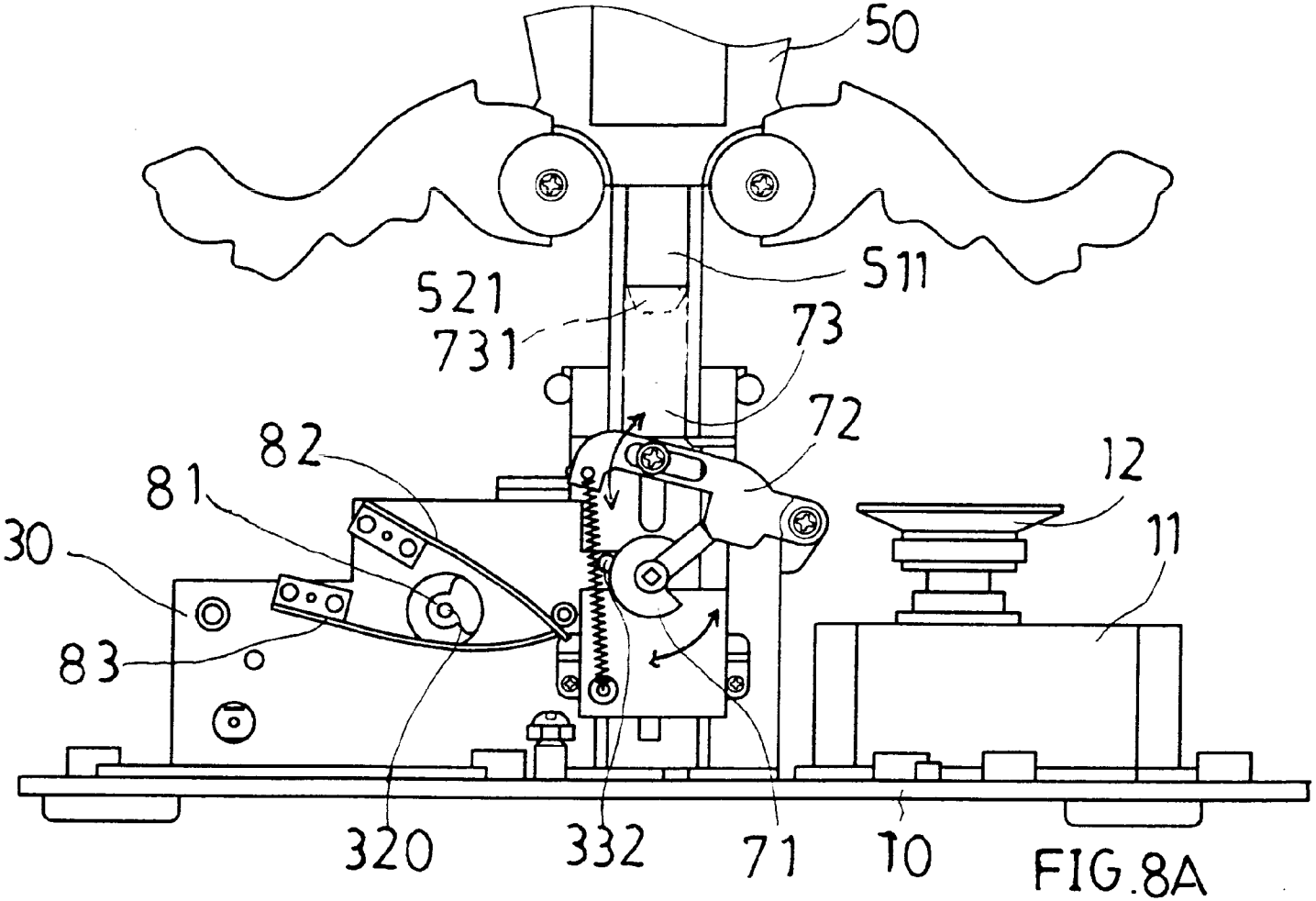
FIG. 8A is a schematic view of the second cam means of this invention.
Figure 9A:
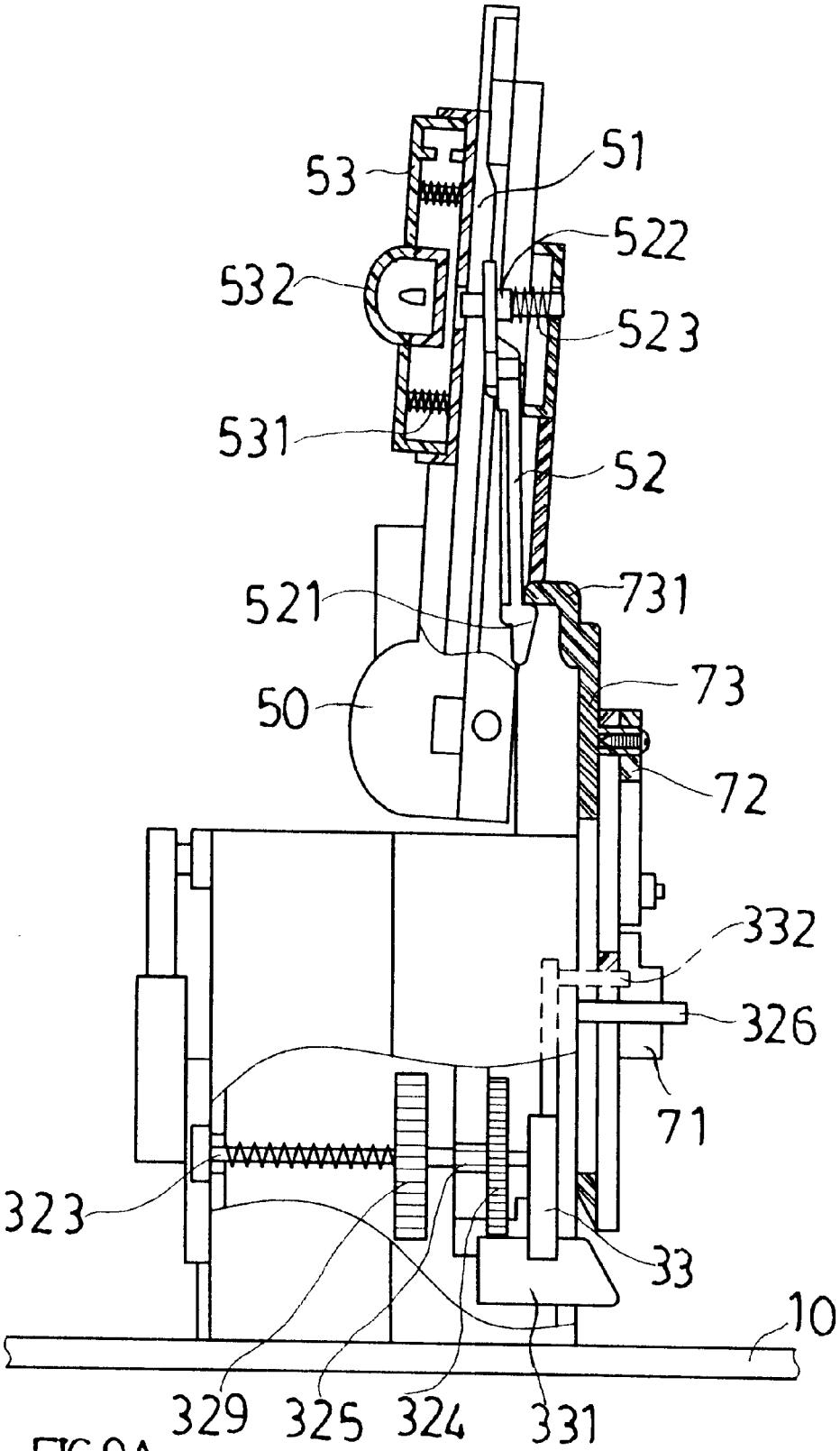
FIG. 9A is a schematic view of a slide block coupled with the moving target of this invention.
Figure 9B:
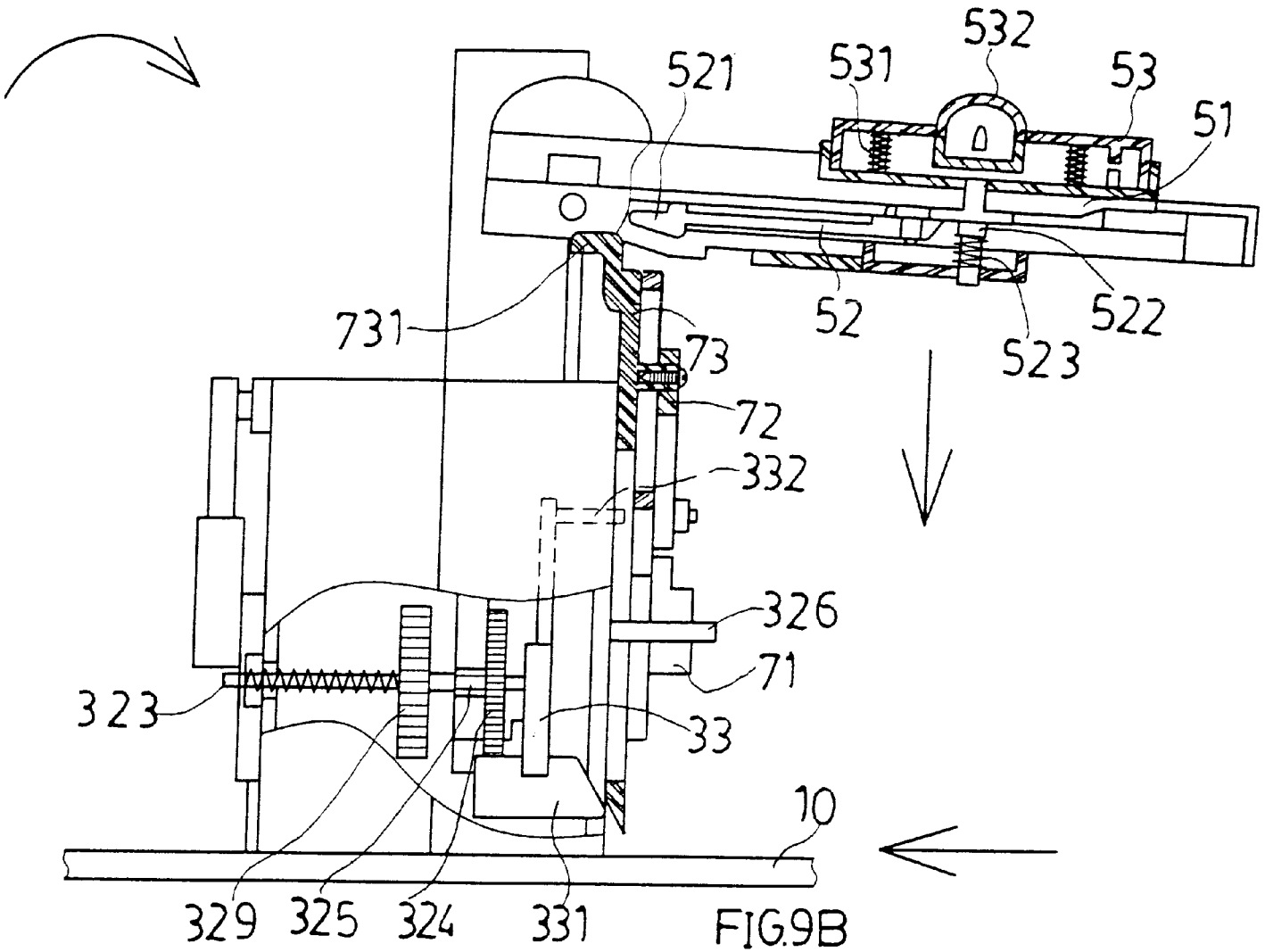
FIG. 9B is a schematic view of the slide block and moving target shown in FIG. 9A in motion.

Referring to FIGS. 7, 8A and 9A, the moving target 50 is formed in substantially a human shape and includes a moving element 51 which has four pivotally moving members serving as human limbs. The moving element 51 extends downwards to form a contact blade 511 which may be moved to sway the moving element 51 like a human in motion. The moving target 50 further has a flip blade 52 which has one end formed a first hook 521 and another end engaged with a pivot shaft 522. One side of the pivot shaft 522 engages with a restore spring 523. At the outer side of the moving target 50, there is a hitting plate 53 which has an inner side pivotally engaged with a plurality of springs 531. At the center of the hitting plate 53, there is a light shade 532.

Figure 6A:
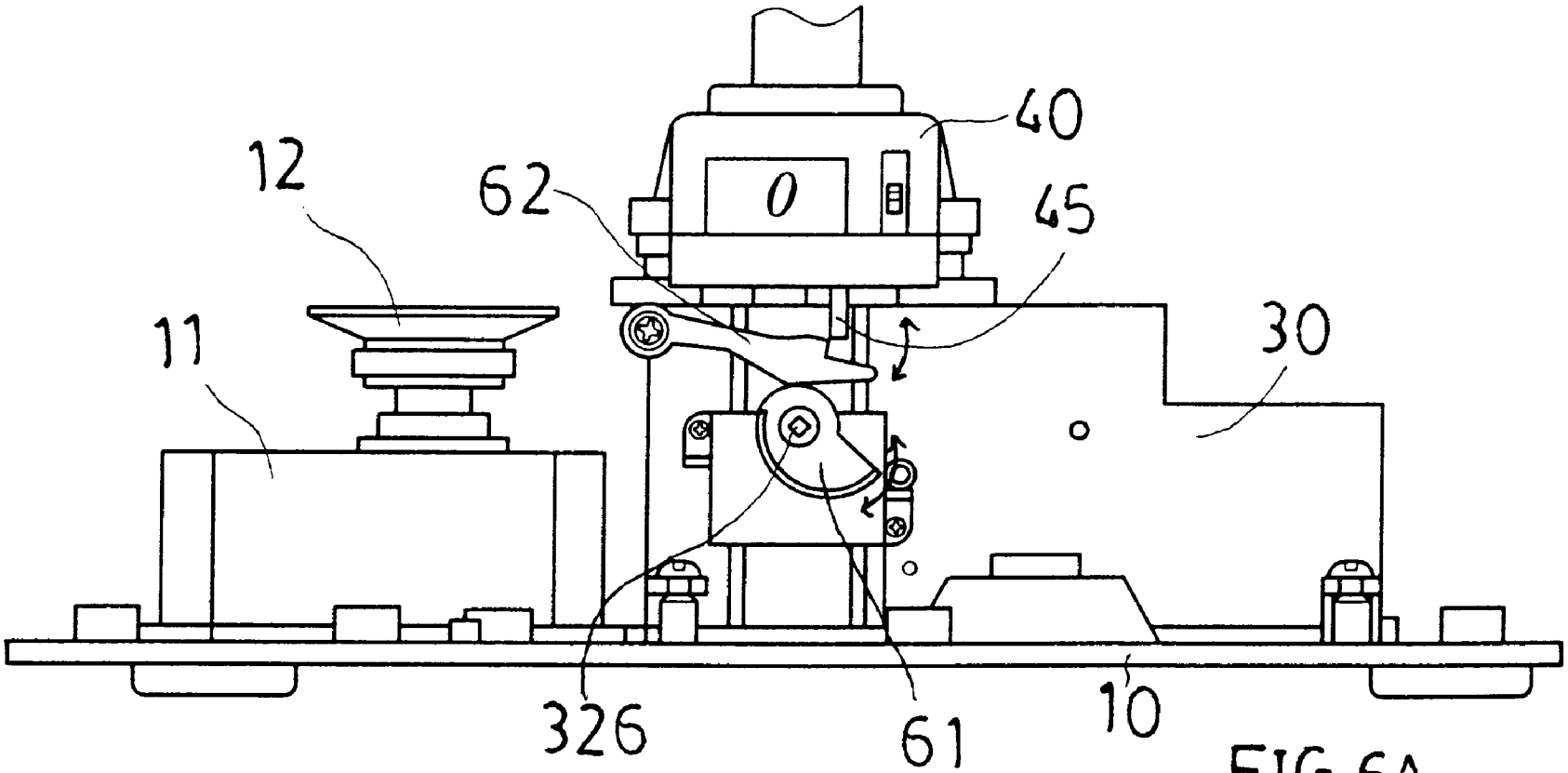
FIG. 6A is a schematic view of the first cam means of this invention.
Figure 6B:
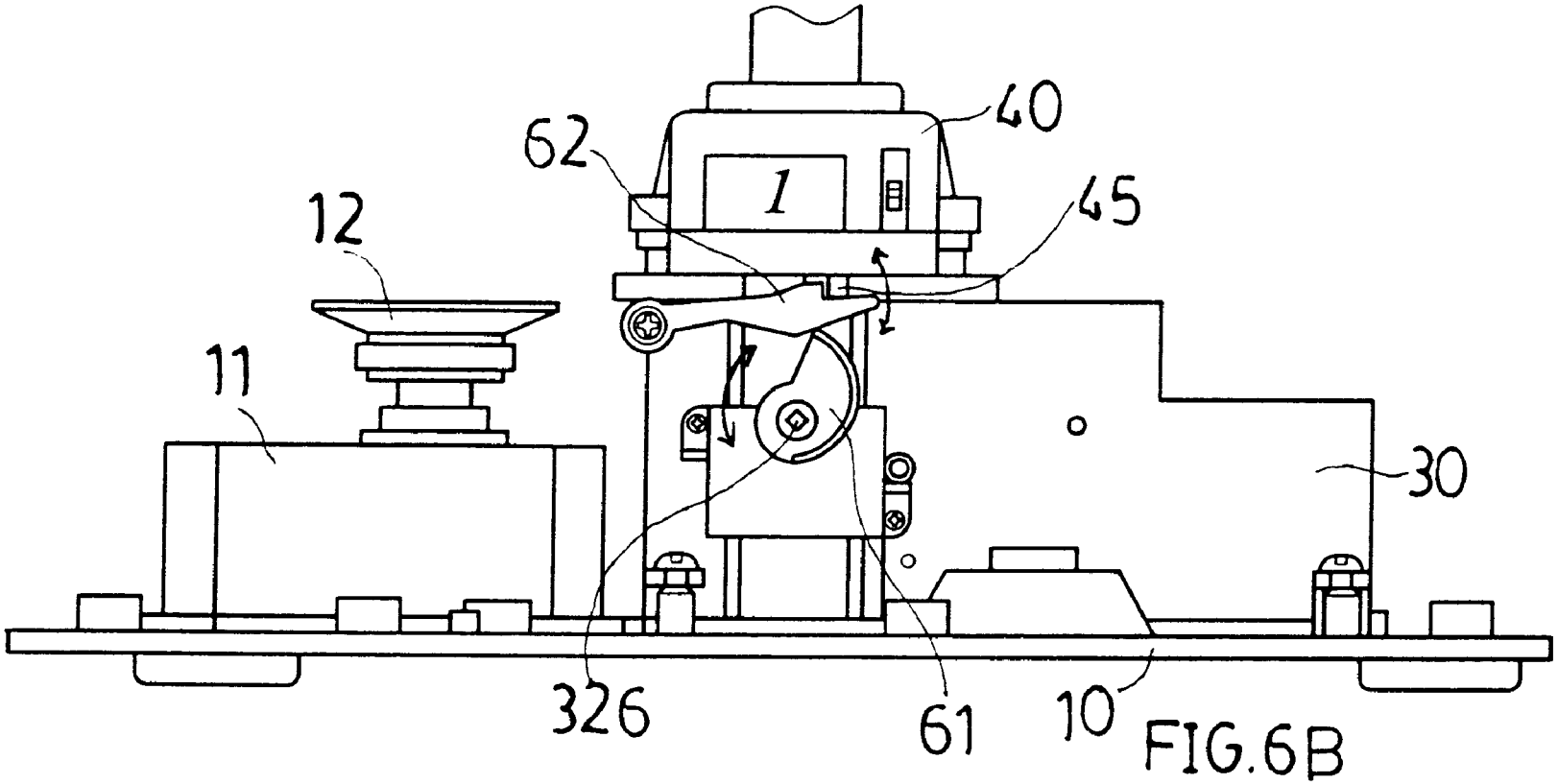
FIG. 6B is a schematic view of the first cam means shown in FIG. 6A in motion.

Referring to FIGS. 6A and 6B, there is a first cam means located at the front side of the gear box 30 that includes a first cam 61 mounted on the fifth spindle 326 and is turnable by the fifth spindle 326. Above the first cam 61, there is a first rocker arm 62 which has one end pivotally engaged with one side of the gear box 30 such that one end is pivotally stationary and another end is movable according to the peripheral contour of the first cam 61 thereby to move the moving block 45 of the counter 40 up and down. The first cam 61 further has a first slide element 63 bent inwards (also shown in FIG. 2) which has a lower end formed a strut 631 bent inwards into the gear box 30 above the extended bar 341 of the first ratchet 34.

Figure 8B:
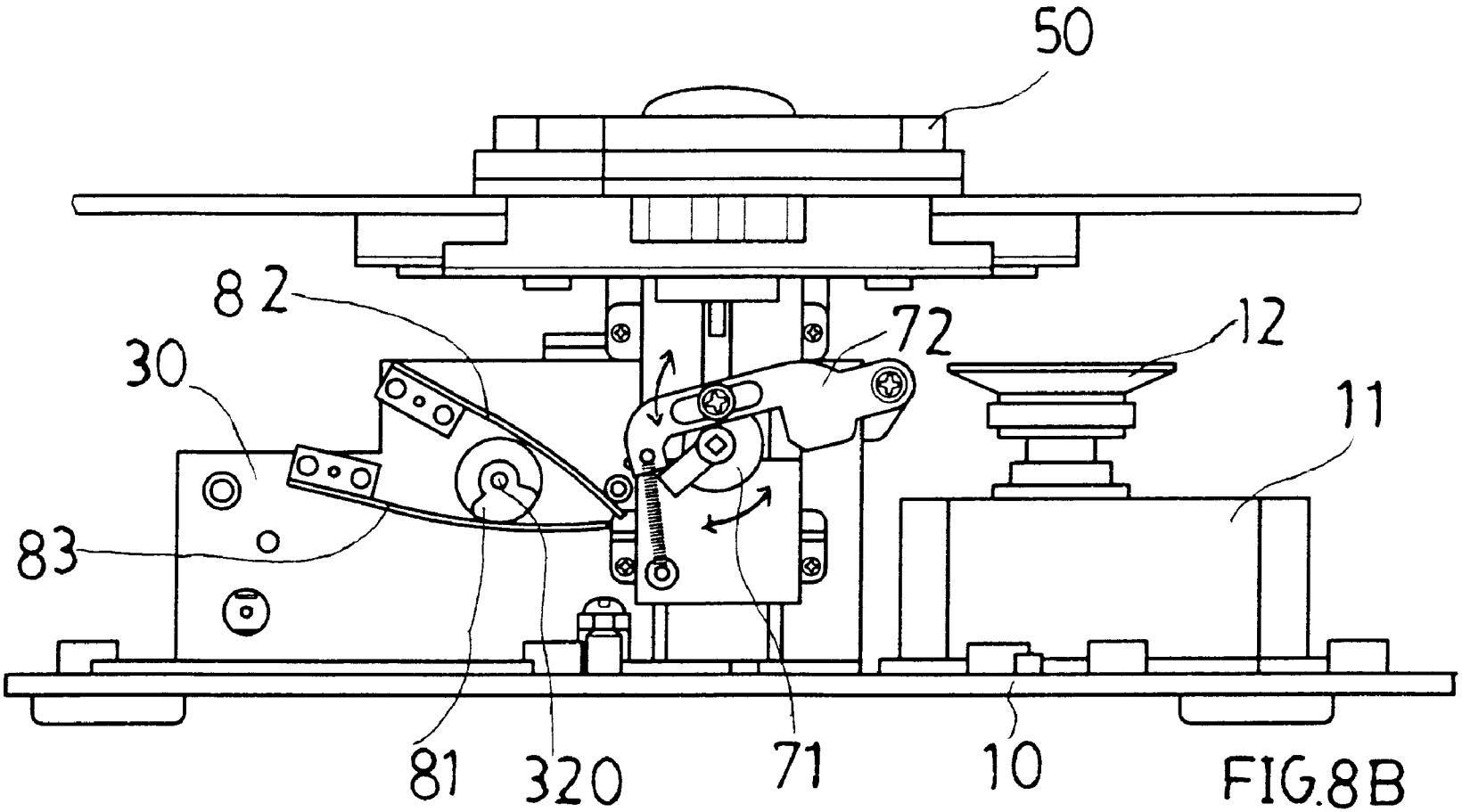
FIG. 8B is a schematic view of the second cam means shown in FIG. 8A in motion.

Referring to FIGS. 8A and 8B, there is a second cam means located at the rear side of the gear box 30 that includes a second cam 71 mounted on the fifth spindle 326 and is turnable by the fifth spindle 326. Above the second cam 71, there is second rocker arm 72 which has one end pivotally engaged with one side of the gear box 30 such that one end is pivotally stationary and another end is movable up and down according to the peripheral contour of the second cam 71. The second rocker arm 72 has an inner side pivotally engaged with a second slide element 73 which has an upper end formed a second hook 731 engageable with the first hook 521 of the moving target 50. The second slide element 73 may be moved up and down by the rocker arm 72 so that the second hook 731 will engage the first hook 521 for erecting the toppled moving target 50 again.

Referring to FIGS. 5A and 8B, there is further a cam switch means located at the rear outer side of the gear box 30 and at one side of the second cam means, and includes a third cam 81 pivotally mounted on the third spindle 320. There are an upper and a lower elastic elements 82 and 83 located respectively above and below the third cam 81. The turning of the third spindle 320 will turn the third cam 81 to make contact or cut off contact with the upper and lower elastic elements 82 and 83 thereby to switch the IC for activating audio and visual effect desired.

When in use at a normal state, the speaker 12 will generate sound and lighting section 21 will generate light, and the driving motor 301 drives the gears rotating, the star gear 326 drives the first ratchet 34 for the extended bar 341 to push the strut 631, thereby the first slide element 63 pushes the contact blade 511 to move the moving element 51 for swaying the limbs to become a moving target 50 and being accompanied with the audio and visual effect.

When the hitting plate 53 is hit and the moving target 50 is toppled, the IC for speech, sound and visual effect is activated (for generating music or hitting sound of selected types), the hitting plate 53 presses against the pivot shaft 522 to separate the first hook 521 from the second hook 731 thereby to make the moving target 50 toppled immediately. The second slide element 73 slides downwards and presses the protrusive block 331 and pushes the press rocker 33 inwards, the stub 332 will be pulled inwards at the same time, the second cam 71 may be turned, and the star gear 329 is separated from the first ratchet 34, and the fifth gear 327 engages with the fourth pinion 325 thereby to drive the fifth spindle 326 rotating, and consequently drive the first cam 61 turning, and also make the first rocker arm 62 push the moving block 45 to make the counter 40 counting once. In the mean time, the second cam 71 turns with the fifth spindle 326 and raises the second rocker arm 72, the second slide element 73 is also being lifted to erect the toppled moving target 50, and the protrusive block 331 is extended outwards again to stop the second slide element 73 from sliding downwards so that the second hook 731 will engage with the first hook 521 to enable the moving target 50 standing upright again for use in the next shooting cycle.

By means of gears and cam structure set forth above, the moving target 50 will topple immediately when hit, and generates audio and visual effect to create desired amusement results. It thus effectively overcomes the deficiency of conventional electronic moving target such as high defective rate, difficult to repair, water impairing and waste of electric power.

What is claimed is:

1. A shooting target, comprising:

a base having a battery chamber, a speaker and a casing mounted thereon housing a gear box in the casing, the gear box including a gear set and a driving motor and a first and a second cam means pivotally located at a front and a rear side of the gear box;

a moving target and a lighting section constituted light emitting elements located above the casing;

a counter located on the casing above the gear box for automatically counting the toppling number of the moving target; and wherein the moving target is toppled immediately when hit, upon which an audio and visual effect is generated.

2. The shooting target of claim 1, wherein the moving target includes a moving element which has four pivotal moving members serving as human limbs, the moving element extending downwards to form a contact blade for moving and swaying the moving members like human limbs, the moving target further having a flip blade which has one end formed as a first hook and another end engaged with a pivot shaft, the pivot shaft being engaged with a restoring spring, the moving target further having a hitting plate located at an outer side thereof, the hitting plate having an inner side pivotally engaged with a plurality of springs and a light shade located at the center thereof.

3. The shooting target of claim 1, wherein the gear box includes a driving motor which engages with a motor gear, the gear set including a first gear, a first pinion, a second gear, a second pinion, a third spindle, a third gear, a third pinion, a fourth spindle, a fourth gear, a fourth pinion, a star gear, a fifth spindle, a fifth gear, a first spring, a press rocker located below the fourth gear having a protrusive block and a stub extended outside the gear box, and a first ratchet located at one side of the second gear having an extended bar formed at one end thereof.

4. The shooting target of claim 1, wherein the counter is located above the gear box and includes an upper cap and a seat and a wheel located therebetween with numerals formed at the perimeter surface of the wheel, and a ratchet located at one side of the wheel, the ratchet being engageable with a pawl of a rocker lever, and through a blocking member and the ratchet and pawl for turning the wheel in one direction, the rocker lever having one end extended outwards to form a cylindrical strut, the seat having a moving block located therein which has one end extended outside the seat and another end contact the strut.

5. The shooting target of claim 1 further having a cam switch means located at a rear outer side of the gear box and at one side of the second cam means, and including a third cam means pivotally mounted on a spindle and an upper elastic element and a lower elastic element located respectively above and below the third cam means which is turnable by the spindle to make contact or cut off contact with the upper and lower elastic elements and thereby to switch an IC for activating audio and visual effect desired.

6. The shooting target of claim 1, wherein the first cam means includes a first cam and a first rocker arm located above the first cam, the first rocker arm having one end pivotally engaged with one side of the gear box such that one end thereof is pivotally stationary and another end is movable, the first cam further having a first slide element bent inwards which has a lower end formed as a strut bent inwards into the gear box above an extended bar of a first ratchet.

7. The shooting target of claim 1, wherein the second cam means includes a cam and a rocker arm located above the cam, the rocker arm having one end pivotally engaged with one side of the gear box such that one end is pivotally stationary and another end is movable up and down according to the perimeter contour of the cam, the rocker arm having an inner side pivotally engaged with a slide element which has an upper end formed as a second hook engageable with a first hook formed at the moving target such that the slide element is slidable up and down with the up and down movement of the rocker arm.

* * * * *